US010542613B2

(12) United States Patent
Farouk et al.

(10) Patent No.: US 10,542,613 B2
(45) Date of Patent: Jan. 21, 2020

(54) SUPPRESSION OF SELF PULSING DC DRIVEN NONTHERMAL MICROPLASMA DISCHARGE TO OPERATE IN A STEADY DC MODE

(71) Applicant: University of South Carolina, Columbia, SC (US)

(72) Inventors: Tanvir Farouk, Irmo, SC (US); Rajib Mahamud, West Columbia, SC (US)

(73) Assignee: UNIVERSITY OF SOUTH CAROLINA, Columbia, SC (US)

( * ) Notice: Subject to any disclaimer, the term of this patent is extended or adjusted under 35 U.S.C. 154(b) by 0 days.

(21) Appl. No.: 15/478,303

(22) Filed: Apr. 4, 2017

(65) Prior Publication Data

US 2017/0290137 A1 Oct. 5, 2017

Related U.S. Application Data

(60) Provisional application No. 62/317,915, filed on Apr. 4, 2016.

(51) Int. Cl.
*H05H 1/24* (2006.01)
*H05H 1/00* (2006.01)

(52) U.S. Cl.
CPC ..... *H05H 1/24* (2013.01); *H05H 1/0018* (2013.01); *H05H 1/0081* (2013.01)

(58) Field of Classification Search
CPC ..... B08B 7/0035; C23C 16/401; C23C 16/56; H01J 37/32009; H01J 37/32018; H01J 37/32045; H01J 37/32174; H01J 37/32348; H01J 37/32376; H01J 37/32935; H01L 21/02203; H01L 21/02247; H01L 21/02332; H01L 21/02362; H01L 29/408; H01L 51/0097; H05H 1/2406; H05H 1/2475; H05H 1/46; H05H 2001/2412; H05H 2001/4652; H05H 2001/4682; H05H 2001/4697; Y10T 428/249969
See application file for complete search history.

(56) References Cited

U.S. PATENT DOCUMENTS 6,827,870 B1 * 12/2004 Gianchandani ..... H01L 21/3065 118/723 E
2006/0062930 A1 * 3/2006 Kumar ..... C23C 8/36 427/569
2006/0081566 A1 * 4/2006 Devries ..... H01J 37/32018 219/121.48
2008/0271748 A1 * 11/2008 De Vries ..... H01J 37/32174 134/1.1
2009/0116166 A1 * 5/2009 Matsumori ..... H05H 1/46 361/230
2009/0229972 A1 * 9/2009 Sankaran ..... C23C 14/165 204/192.32

(Continued)

*Primary Examiner* — Renan Luque
(74) *Attorney, Agent, or Firm* — Burr & Forman LLP; Douglas L. Lineberry

(57) ABSTRACT

The current disclosure relates to a suppressor circuit configuration for extending the stable region of operation of a DC driven micro plasma discharge at atmospheric and higher pressures. The current disclosure also provides various systems for suppressing a self-pulsing regime of a direct current driven micro plasma discharge comprising, at least, a power supply, a ballast resistor, a plasma discharge, and an inductor.

8 Claims, 6 Drawing Sheets

(56) References Cited

U.S. PATENT DOCUMENTS

| | | | | |
|---|---|---|---|---|
| 2010/0076286 | A1* | 3/2010 | Feldman | C12Q 1/001<br>600/347 |
| 2010/0252199 | A1* | 10/2010 | Marakhtanov | H01J 37/32091<br>156/345.48 |
| 2011/0014424 | A1* | 1/2011 | De Vries | H01J 37/32348<br>428/141 |
| 2017/0246468 | A1* | 8/2017 | Kalghatgi | A61N 1/44 |
| 2018/0053633 | A1* | 2/2018 | Glazek | H01J 37/32174 |

* cited by examiner

SUPPRESSION OF SELF PULSING DC DRIVEN NONTHERMAL MICROPLASMA DISCHARGE TO OPERATE IN A STEADY DC MODE

BACKGROUND OF THE INVENTION

1) Field of the Invention

The present invention relates to a suppressor circuit configuration for extending the stable region of operation of a DC driven micro plasma discharge at atmospheric and higher pressures.

2) Description of Related Art

Plasma is a partially or fully ionized gas consisting of various particles, such as electrons, ions, atoms, and molecules. For the quantitative description of plasma, the term of temperature is usually applied. Thermal plasma is in a state where almost all its components are at thermal equilibrium. In nonthermal plasmas (NTPs), temperature (i.e. kinetic energy) is not in thermal equilibrium, and differs substantially between the electrons and the other particles (ions, atoms, and molecules). In this sense an NTP is also referred to as a "nonequilibrium plasma" or a "cold plasma". Because of the small mass of electrons, they can be easily accelerated under the influence of an electric field. The temperature of electrons typically ranges from 10 000 K to 250 000 K (1-20 eV).

In NTPs, the complex plasma chemistry is driven by electrons. They perform ionization, necessary to sustain the plasma; in addition, they are responsible for atomic/molecular excitation, dissociation and production of "exotic" species. The result is an active gaseous medium that can be safely used without thermal damage to the surrounding. Such exceptional non-equilibrium chemistry is the base of plasma applications in lighting technology, exhaust gas treatment and material processing.

There are several methods to generate non-thermal plasmas, e.g., corona discharge, pulsed corona, microwave, radio frequency (RF) plasma, ionizing irradiation, etc. When charged particles are in minority, heating of neutral molecules is limited. Thus, diffuse plasmas where the fraction of ionized species is below 0.1%, are usually non-thermal. This situation is readily achieved under reduced pressures, in the range of 10 to 1000 Pa. The effect of low pressure is double: in a rarefied gas ionization events are scarce, which keeps the charge density low. Moreover, the frequency of elastic collisions between electrons and atoms/molecules is low, so electrons do not have much chance to convey their energy to the gas. Usually, a discharge in gas is induced electrically, by applying voltage to a set of electrodes. In this case only charged species (electrons and ions) can gain energy from the electric field. The plasmas generated by electric fields are divided into: direct current (DC) discharges, pulsed DC discharges, radio frequency (RF) discharges, and microwave discharges.

Low-pressure plasmas are of great value in fundamental research as well as plasma technology, but they have many serious drawbacks. These plasmas must be contained in massive vacuum reactors, their operation is costly, and the access for observation or sample treatment is limited. Therefore, one of the recent trends focuses on developing new plasma sources, which operate at atmospheric pressure, but retain the properties of low-pressure media.

Non-thermal atmospheric plasmas may be created using one or more of the following principles:

(1) Transient plasmas. The frequency of energy transfer in collisions between electrons and gas is given by $v[s^{-1}]=(m_e/m_a)2n_a\delta_{ea}v_e$ where $m_e=m_a$ is electron to atom(molecule) mass ratio, $\delta_{ea}$ is their mutual collision cross-section, $n_a$ is the atom density and $v_e$ is the electron velocity. In atmospheric plasmas n is about $10_8$ collisions/s; for efficient gas heating at least 100-1000 collisions are necessary. Thus, if the plasma duration is shorter than $10^{-6}$-$10^{-5}$ s, gas heating is limited. Of course, for practical purposes such plasma has to be operated in a repetitive mode, e.g., in trains of microsecond pulses with millisecond intervals.

(2) Micro-plasmas. Gas heating occurs in the plasma volume, and the energy is carried away by thermal diffusion/convection to the outside. If the plasma has a small volume and a relatively large surface, gas heating is limited. This situation can be also achieved for a spherical plasma glow.

(3) Dielectric barrier discharges (DBD's). These plasmas are typically created between flat parallel metal plates, which are covered by a thin layer of dielectric or highly resistive material. Usually they are driven by a high frequency electric current (in the kHz range), but it is also possible to obtain a DBD by simple transformation of 50 Hz/220 V network voltage to about 1 kV. The dielectric layer plays an important role in suppressing the current: the cathode/anode layer is charged by incoming positive ions/electrons, which reduces the electric field and hinders charge transport towards the electrode. DBD's have typically low ionization degrees (ion densities of $10^{19}$-$10^{20}$ $m^{-3}$) and currents in the order of mA. Besides, the electrode plates are quite large (10 cm) and the distance between them usually does not exceed a few millimeters. Thus, DBD has a large surface-to-volume ratio, which promotes diffusion losses and maintains a low gas temperature (at most a few tens of degrees above the ambient). The only serious drawback of a DBD is its limited flexibility. Since the distance between the plates must be kept small, treatment of large and irregular samples is impossible.

In recent decades, non-thermal plasmas have become prominent in surface processing technology. At present, virtually any surface treatment can be performed in a plasma reactor: etching (fabrication of semiconductor elements); deposition of amorphous silicon layers for solar cells; deposition of various thin coatings: hard/protective layers (diamond), nano-structured composite films, cleaning/ashing, tailoring of surface properties: wettability, surface energy, adhesion. The versatility of plasma interactions with various surfaces was the inspiration for a completely new application: plasma-surface treatment in medical care.

Microplasmas are plasmas of small dimensions and may be generated at a variety of temperatures and pressures, existing as either thermal or non-thermal plasmas. Non-thermal microplasmas that can maintain their state at standard temperatures and pressures are readily available and accessible as they can be easily sustained and manipulated under standard conditions. Therefore, they can be employed for commercial, industrial, and medical applications, giving rise to the evolving field of microplasmas.

Microplasma size ranges from tens to thousands of micrometers and are attractive for commercial applications, e.g., plasma jet, plasma needle, biomedical applications, MEMS technology due to their operational viability and low energy consumption. They are widely used for attaining nonthermal and non-equilibrium discharge at atmospheric and higher pressures due to the fact that their small sizes inhibit the ionization overheating instability through rapid cooling. DC micro plasma discharge operates in a "normal" glow mode at atmospheric and higher pressure. At atmospheric pressure reaction rates are higher and processes can occur more rapidly. For example, the key to having an atmospheric pressure micro-plasma that can be used for plasma enhanced chemical vapor deposition (PECVD) is to provide conditions, which maintain the non-equilibrium state. Non-thermal plasma is required because in PECVD excited and reactive species formed from the precursors are desired. Thermal plasma would result in near complete dissociation of precursors and excessive heating of the substrate.

However, due to their small size, these devices are susceptible to instability from external disturbances. The sources of these disturbances, at many instances, are contributed from the external driving circuits, e.g., the external circuit parameter which triggers self-pulsing oscillations. The oscillation in the negative differential resistance (NDR) region varies from Hz to MHz ranges depending on the parasitic capacitance and discharge current. The effectiveness and reliable operation of DC microplasma devices depends on stable discharge condition and is hindered by the self-driven and sustaining instability resulting from external parameters.

Though parallel plates, pin-plates and micro hollow cathode discharge (MHCD) geometry are the most widely used configurations to obtain a stable discharge for a wide range of current and pressures, the instability in the NDR region is a norm and is unavoidable. However the NDR region in discharge current space is not absolute.

Very few studies have focused on attaining stability in the NDR region of micro plasma operation. The low pressure experiments and subsequent modeling studies in the art demonstrate that self-pulsation of plasma may be suppressed and the region of stable operation can be extended by including a monitoring resistance Rm in series and downstream of the discharge. To attain a stable discharge the monitoring resistance has to be significantly larger than the discharge resistance $R_m > R_{discharge}$. Conditions where an extremely large value of $R_m$ is required for establishing a stable discharge have not been not deemed practical. Ballast resistance being larger than the discharge resistance, i.e. $R_{ballast} > R_{discharge}$, has also been identified/proposed to act as an instability suppressor for low pressure DC discharges operating at low currents because instability of atmospheric pressure microplasma discharges can be suppressed by reducing the parasitic capacitance of the circuit. However, this method has a minimum current boundary due to the practical limits of reducing the parasitic capacitance of the external circuit.

What is needed in the art is a suppressor circuit configuration that can extend the stable region of operation of a DC driven micro plasma discharge—extending the discharge current range of atmospheric and high pressure micro plasma discharge.

BRIEF DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

Figure 1:
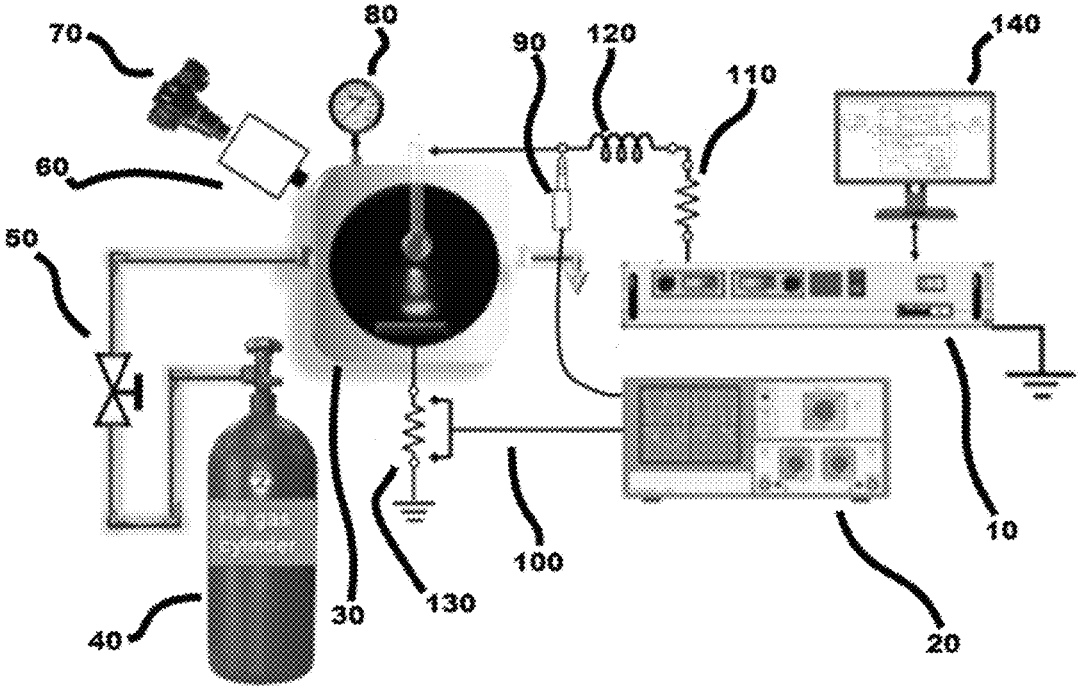
FIG. 1 shows an experimental setup wherein $R_{ballast}$, $L_x$, and $R_{shunt}$ represents ballast resistance, external inductor and shunt resistance respectively.

It will be understood by those skilled in the art that one or more aspects of this invention can meet certain objectives, while one or more other aspects can meet certain other objectives. Each objective may not apply equally, in all its respects, to every aspect of this invention. As such, the preceding objects can be viewed in the alternative with respect to any one aspect of this invention. These and other objects and features of the invention will become more fully apparent when the following detailed description is read in conjunction with the accompanying figures and examples. However, it is to be understood that both the foregoing summary of the invention and the following detailed description are of a preferred embodiment and not restrictive of the invention or other alternate embodiments of the invention. In particular, while the invention is described herein with reference to a number of specific embodiments, it will be appreciated that the description is illustrative of the invention and is not constructed as limiting of the invention. Various modifications and applications may occur to those who are skilled in the art, without departing from the spirit and the scope of the invention, as described by the appended claims. Likewise, other objects, features, benefits and advantages of the present invention will be apparent from this summary and certain embodiments described below, and will be readily apparent to those skilled in the art. Such objects, features, benefits and advantages will be apparent from the above in conjunction with the accompanying examples, data, figures and all reasonable inferences to be drawn therefrom, alone or with consideration of the references incorporated herein.

SUMMARY OF THE INVENTION

In a first embodiment, the current disclosure provides an instability suppressor circuit for self-pulsing direct current driven microplasma discharge comprising. The circuit comprises a power supply, a ballast resistor, a plasma discharge, an inductor connected in series with the power supply, ballast resistance and plasma discharge. The suppressor circuit adds a positive impedance making plasma from the plasma discharge less sensitive to a change in voltage with respect to a change in current. The suppressor circuit functions at atmospheric pressure and above. Further, the inductor increases the combined response time of the plasma and the inductor, such that $t\ L/R_{discharge} > t\ R_{ballast}C_p$. Even further, the plasma discharge characteristics are obtained from the solution of the below equation:

$$V = L_x \frac{dI}{dt} + R_{discharge} I$$

$$V = V_s - IR_{discharge} - R_{ballast} C_p \frac{dV}{dt}$$

Still further, the inductor shifts a negative differential resistance region into lower current regimes. Further yet, two electrodes having a separation distance of from 100 μm to 400 μm form the plasma discharge.

In an alternative embodiment, a system for suppressing a self-pulsing regime of a direct current driven microplasma discharge is provided. The system comprises a power supply, a ballast resistor, a plasma discharge, and an inductor connected in series with the ballast resistance and plasma discharge. The inductor suppresses oscillation of the plasma discharge, thereby establishing a steady plasma discharge. The system comprises a positive impedance making plasma from the plasma discharge less sensitive to a change in voltage with respect to a change in current. Also, the system functions at atmospheric pressure and above.

Further, varying an inductance value increases a response time of plasma to a value wherein t $Lx/R_{discharge}$>t $R_{ballast}C_p$ thereby making a driving circuit response time shorter. Still further, the system shifts a negative differential resistance region into lower current regimes. Yet further, the inductor increases the combined response time of the plasma and the inductor, such that t $L/R_{discharge}$>t $R_{ballast}C_p$. Furthermore, the plasma discharge characteristics are obtained from the solution of the below equation:

$$V = L_x \frac{dI}{dt} + R_{discharge} I$$

$$V = V_s - IR_{discharge} - R_{ballast} C_p \frac{dV}{dt}$$

Even further, the plasma discharge is formed between two electrodes having a separation distance of from 100 μm to 400 μm.

DETAILED DESCRIPTION OF A PREFERRED EMBODIMENT

With reference to the drawings, the invention will now be described in more detail. Unless defined otherwise, all technical and scientific terms used herein have the same meaning as commonly understood to one of ordinary skill in the art to which the presently disclosed subject matter belongs. Although any methods, devices, and materials similar or equivalent to those described herein can be used in the practice or testing of the presently disclosed subject matter, representative methods, devices, and materials are herein described.

Unless specifically stated, terms and phrases used in this document, and variations thereof, unless otherwise expressly stated, should be construed as open ended as opposed to limiting. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise.

Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

The current disclosure provides suppression of the self-pulsing regime of a DC driven microplasma discharge in a parallel plate, pin to plate, or similar configuration by employing an external suppressor circuit. The external circuit, which is an integral part of the discharge system, has often been considered to characterize and study the self-pulsing oscillatory region. From the external circuit constraint, self-pulsing in the NDR region is obtained when the external circuit response time becomes higher than the ion transit time, i.e. $tR_{ballast}C_p > t_{plasma}$. FIG. 1 shows a schematic of the experimental setup of the current disclosure wherein $R_{ballast}$, $L_x$, $R_{shunt}$ represent ballast resistance, the external inductor and shunt resistance respectively. The external inductor is "open bracket" channel mount type that is vacuum impregnated with polyurethane varnish for long operation life. The inductor has an iron core, coil composition. As FIG. 1 illustrates, the experimental set-up may include a high voltage power supply 10, an oscilloscope 20, a micropositioner 30, a gas supply 40, which may be helium, a throttle valve 50, a microscope 60, a camera 70, a pressure gauge 80, and a voltage probe 90, and current 100 in order to examine $R_{ballast}$ 110, $L_x$ 120, and $R_{shunt}$ 130. The set-up may be connected to a monitoring device 140 to view the system in progress.

The suppression circuit of the current disclosure comprises an inductor connected in series with the ballast resistance and the discharge, which increases the combined response time of the plasma and the inductor, such that t $L/R_{discharge}$>t $R_{ballast}C_p$. As a test case, helium micro plasma operating at atmospheric pressure was studied. However, higher pressures are considered within the scope of this disclosure. Three inter-electrode separation distances were investigated 100 μm, 200 μm and 400 μm corresponding to pd values of 7.6, 15.2, and 30.4 Torr-cm. The electrode arrangement consisted of a spherical anode and a flat cathode disk having diameters of 12.7 and 10 mm respectively.

The spherical anode was used to maintain the discharge in the central region (i.e. the smallest gap) to ease the visualization process. It should be noted that despite the sphere-plate type electrode design the radial size of the discharge is sufficiently small such that the electrode configuration can be considered to be a parallel-plate arrangement. The anode electrode was attached to a micro-positioner for varying the inter electrode separation distance. The electrodes were contained inside a stainless pressure chamber with quartz window viewports for discharge visualization. The chamber is sealable and there are gas inlets and outlets for testing in a variety of pressures and discharge gases.

The experiments were conducted using a Spellman SL20P2000 DC power supply 20 setup connected in series to a 100 kΩ ballast resistor, an inductor (oscillation suppression experiments) and the discharge. For time dependent current measurements a current shunt (10 kΩ) was placed between one electrode of the discharge and the ground. A North Star PVM-4 high impedance 1000:1 voltage probe was placed directly adjacent to the anode to measure the discharge voltage. Both the voltage probe and the current shunt are connected to an oscilloscope (Agilent Technologies InfiniiVision MSO7054B) for DC or time dependent measurements. The parasitic capacitance of the external circuit was measured as 40 pF. Experiments were conducted with high purity helium feed gas (AirGas, 99.997% purity level). For visualizing the discharge, a Nikon D7000 camera was mounted on a microscope focused on the discharge. The microscope-camera setup provided a variable magnification.

Figure 2:
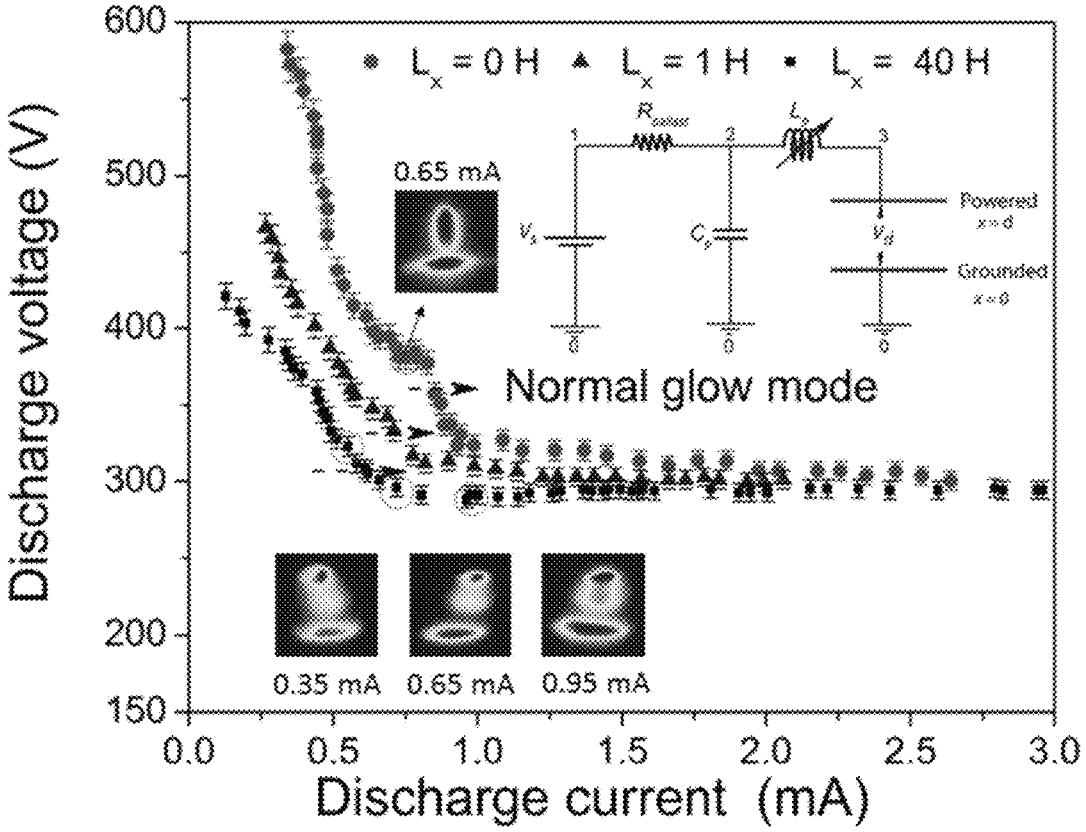
FIG. 2 illustrates voltage current characteristics of a DC driven micro plasma discharge operating in helium at atmospheric pressure ($d_{inter\text{-}electrode}$=200 μm, $R_{ballast}$=100 kΩ, pd=15.2 Torr-cm) in presence of external inductor.

FIG. 2 shows the voltage-current (VI) characteristics with and without the presence of the inductor element. Due to the oscillatory nature of the discharge in the NDR regime, the VI characteristics in the NDR region is obtained from the RMS voltage and current. The VI curves manifest the usual shape that corresponds to the NDR regime, i.e. subnormal mode at lower currents and then attains the "flat" normal glow as the discharge current increases. Though self-pulsing is a NDR phenomenon, the region near the inflection point (i.e. transition from 'subnormal' to 'normal') attains a steady "non-pulsing" discharge condition.

The presence of an inductor was found to extend the normal glow region operation to lower currents—shifting the NDR region. The measurement with different inductance value shows that, the 'normal' glow region of the discharge can be extended to lower currents with increasing inductance value. The transition from 'subnormal' to 'normal' glow occurs at 0.8 mA in absence of any external inductor element. The transition point shifted to 0.65 mA and 0.40 mA for a 1 H and 40 H respectively The NDR region is still retained with the different inductors however the slope changes significantly. The slope of the NDR region varies from 440 kΩ, 305 kΩ, and 225 kΩ for an inductance value of 0 H, 1 H, and 40 H, respectively. The decrement of the slope of the NDR region is also an indication of the fact that the inductor element is extenuating the NDR response of the system. The suppressing circuit element adds a positive impedance to the system and the plasma become less sensitive to the change in voltage with respect to the change in current.

Figure 3:
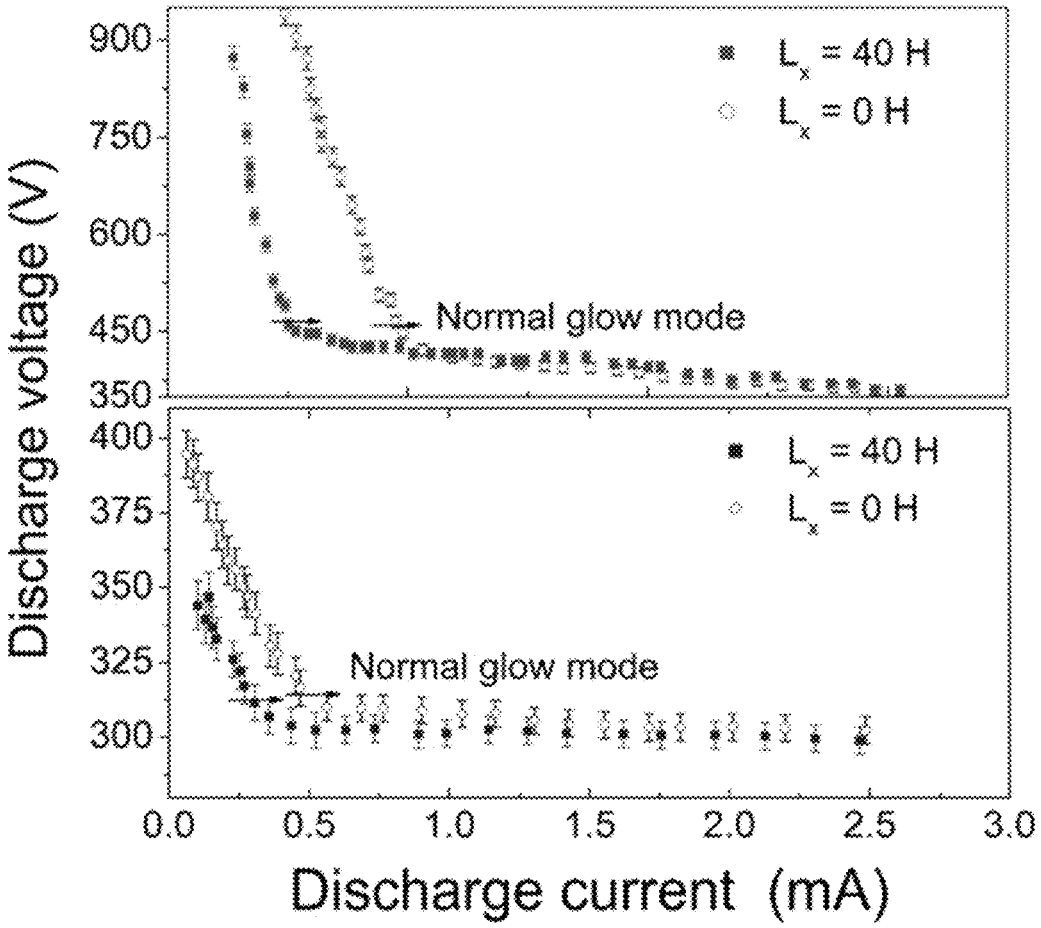
FIG. 3 shows voltage current characteristics of a DC driven micro plasma discharge operating in helium at atmospheric pressure with and without the suppression circuit for different inter-electrode separation distance a) $d_{inter\text{-}electrode}$=400 μm, $R_{ballast}$=100 kΩ, pd=30..4 Torr-cm, b) $d_{inter\text{-}electrode}$=100 μm, $R_{ballast}$=100 kΩ, pd=7.6 Torr-cm.

Images of the discharges for different discharge currents in both the steady and pulsing regime for the same pd value are provided as insets in FIG. 2. False coloring scaled as a function of emission intensity is employed to obtain a better insight of the discharge structure. The time averaged image of a pulsing discharge shows that the discharge has a uniform intensity (both the positive column and negative glow being equally bright) without the presence of a Faraday dark space. The discharge images in presence of the inductor clearly shows that the classical and distinctive DC glow structure is attained—anode glow, Faraday dark space and negative glow. The 'normal' glow is also retained which is confirmed by the increasing cathode spot and the constant current density of 1.8 mA/cm$^2$. For identical discharge current of 0.65 mA, the inductor suppresses the oscillation of the discharge and establishes a steady discharge that has the distinctive steady DC glow characteristics. The discharge images further confirms that even at the lowest discharge current the plasma is operating in the 'normal' mode. The VI characteristics for two other inter-electrode spacing, 100 μm and 400 μm corresponding to pd values of 7.6 and 30.4 Torr-com show similar instability suppression and extension of the normal glow regime in the presence of external inductor element (FIG. 3). The inclusion of 40 H inductor altered the normal glow inception from 0.46 mA to 0.30 mA and from 0.90 mA to 0.50 mA for electrode spacing of 100 μm and 400 μm respectively.

Figure 4:
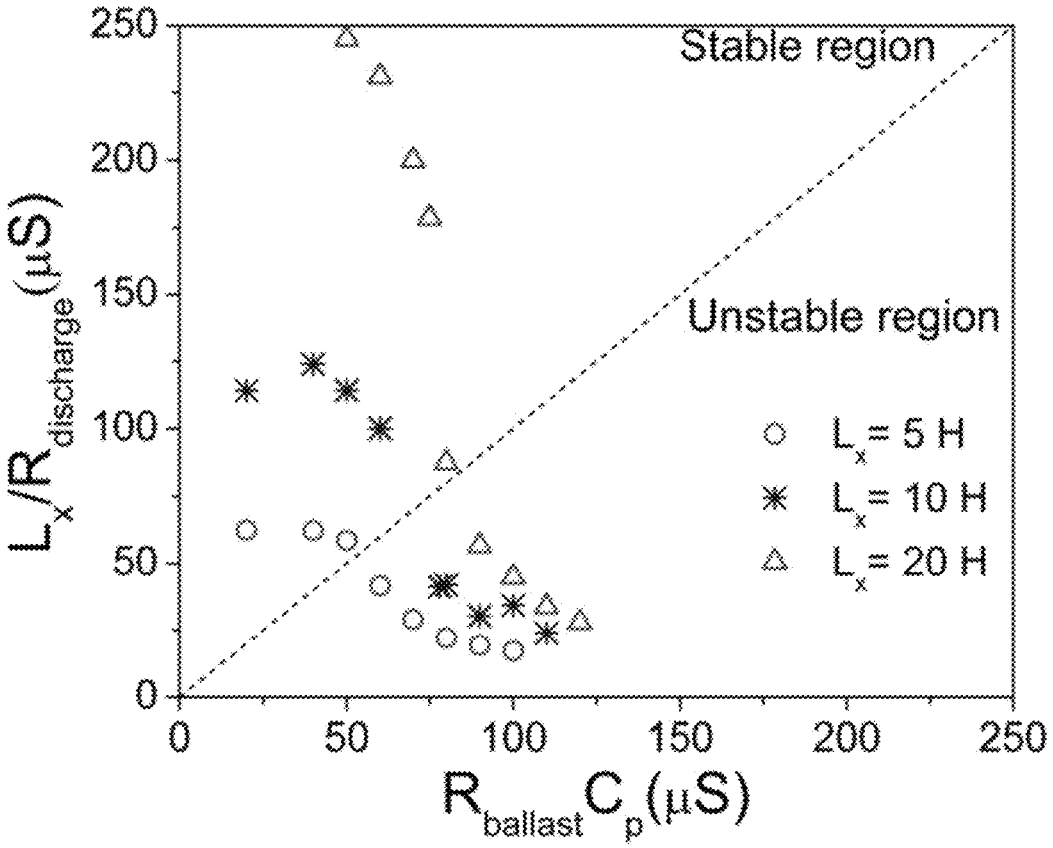
FIG. 4 illustrates a stability map based on the suppression of oscillatory discharge with the inclusion of external inductance ($R_{ballast}$=100 kΩ, Cp=100 pF). Each symbol represents an individual microplasma discharge state.

Based on the interaction of the different circuit element, especially the representative characteristics response time, a stability map denoting regimes of pulsing and stable operation can be proposed. FIG. 4 shows such a stability regime map where each of the symbols represents individual simulated cases. The 45 degree line in the stability plot represents the condition where t $Lx/R_{discharge}=tR_{ballast}C_p$ and demarcates stable and unstable operation regimes. For conditions where t $Lx/R_{discharge}<tR_{ballast}C_p$ a self-pulsing DC discharge that undergoes relaxation type oscillation is observed. By varying/incrementing the inductance value, the combined time response of plasma with inductor can be increased to a value where t $Lx/R_{discharge}>tR_{ballast}C_p$ making the driving circuit response time comparably shorter and establishing a stable DC operation can be obtained.

As explained herein, an instability suppressor circuit for self-pulsing DC driven microplasma discharge has been tested over a range of pressure and electrode separation distance. The external circuit configuration was successful in suppressing self-pulsing of the discharge, extending the normal glow regime to lower currents. The negative differential resistance (NDR) region was observed to shift further left in the voltage-current parametric space (i.e. lower current) and the slope of the NDR region was decreased substantially. Currently there are no existing technologies aimed at suppressing the instability at atmospheric and higher pressures. The current disclosure employs a simple external circuit configuration that is inexpensive to implement. The potential user for this technology is in the field of plasma enhanced chemical vapor deposition (PECVD), plasma surface treatment, plasma lighting, etc.

Figure 5:
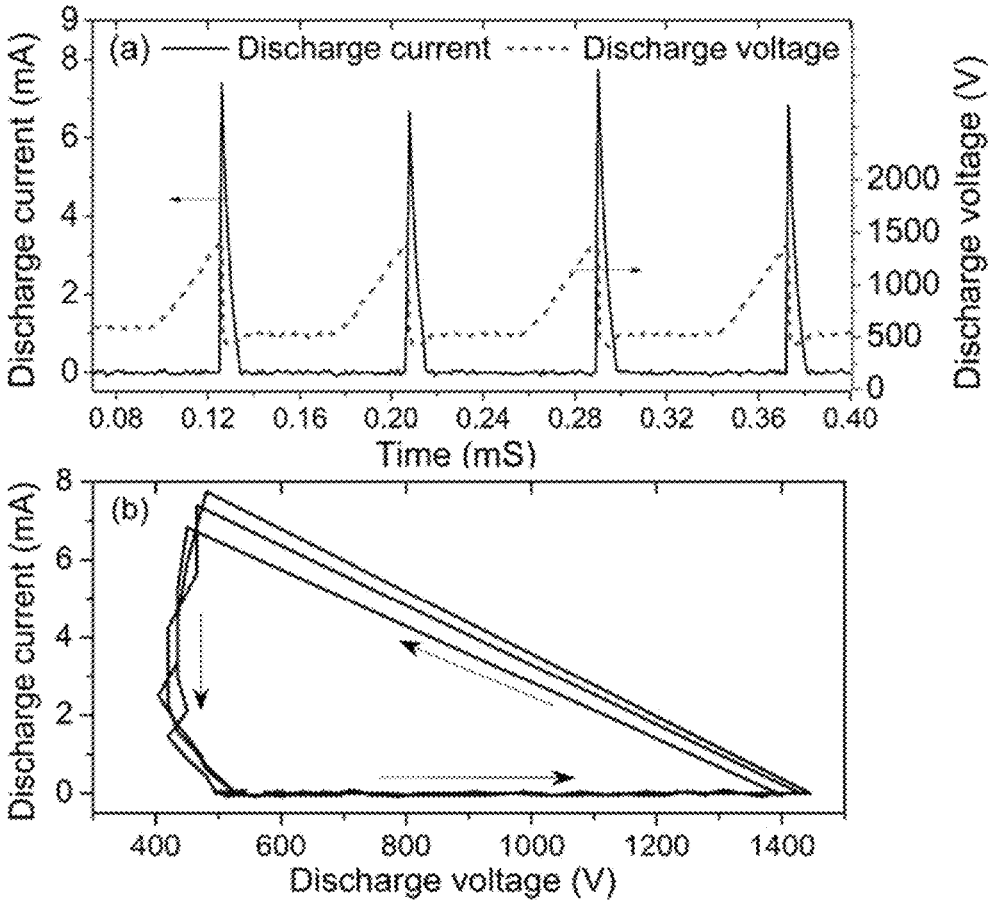
FIG. 5 shows: (a) transient discharge voltage and current profile in the NDR region without the presence of any suppressing circuit element; and (b) time dependent voltage versus time dependent current ($d_{inter\text{-}electrode}$=200 □m, $R_{ballast}$=100 kΩ, pd=15.2 Torr-cm).

The temporal evolution of the voltage and current for a standard self-pulsing discharge (without any suppressing circuit element) is presented in FIG. 5. FIG. 5 shows: graph (a) illustrating transient discharge voltage and current profile in the NDR region without the presence of any suppressing circuit element; and graph (b) that shows time dependent voltage versus time dependent current ($d_{inter\text{-}electrode}$=200 □m, $R_{ballast}$=100 kΩ, pd=15.2 Torr-cm). In the pulsing mode the voltage and current exhibit a phase difference of 15°. The temporal profiles have similarity to those obtained for a moderate pressure self-pulsing MHCD.

In a single pulse, the discharge voltage exhibits three different stages. During the current spike, the discharge voltage shows a sudden dip which is followed by a gradual increase to a moderate voltage that is maintained for a significant duration. A linear ramping to the highest voltage is observed soon after. The phase space diagram for the voltage-current is presented in FIG. 5, see graph b, which is found to attain a triangular shape. The phase space diagram has three different regions. During the extremely low current stage the voltage sharply increases from 500V to 1250V (stage 1). One can then see a decrease in discharge voltage with an increase in the discharge current (stage 2). Following this stage the current decreases sharply followed with a slight increase in the voltage (stage 3).

Based on the experimental results, a circuit model is solved to investigate the stability condition in details. Circuit models have been widely used to study the instability in the NDR region for parallel plate or MHCD geometry but not distinctively on stability suppression concepts. The discharge characteristics in the presence of the suppression element (i.e. inductor) can be obtained from the solution of Eq. (1) and (2).

$$V = L_x \frac{dI}{dt} + R_{discharge} I$$

-continued $$V = V_s - IR_{discharge} - R_{ballast}C_p\frac{dV}{dt}$$

The solution of the circuit model is based on the choice of the discharge resistance. It is a common norm to model the nonlinear NDR discharge resistance as a function of discharge current. For example, prior work modeled the NDR resistance with a second order polynomial expression which predicted the discharge instability and the temporal profile of the discharge voltage for low pressure systems. However, the polynomial form of expression was unable to predict the current pulse shape which has a distinctive spike followed by a very low current stage.

More recent studies have proposed a hyperbolic tangent form of discharge resistance profile, which resulted in better agreement between experiments and predictions. However, these discharge resistance were suggested for moderate pressure MHCD geometry.

For the current model the discharge resistance is expressed as:

$$R_{discharge} = C_1\tanh\left(\frac{I - I_{lim}}{p}\right) + C_2$$

Where, the constants, $C_1$=−1920Ω, $C_2$=2000Ω, $I_{lim}$=0.317 mA, and p=0.45 mA, were obtained from experimental fits. The system of equations for the circuit model is solved with an implicit Runge-Kutta solver in MATLAB with the accuracy level of $10^{-3}$~$10^{-6}$.

Figure 6:
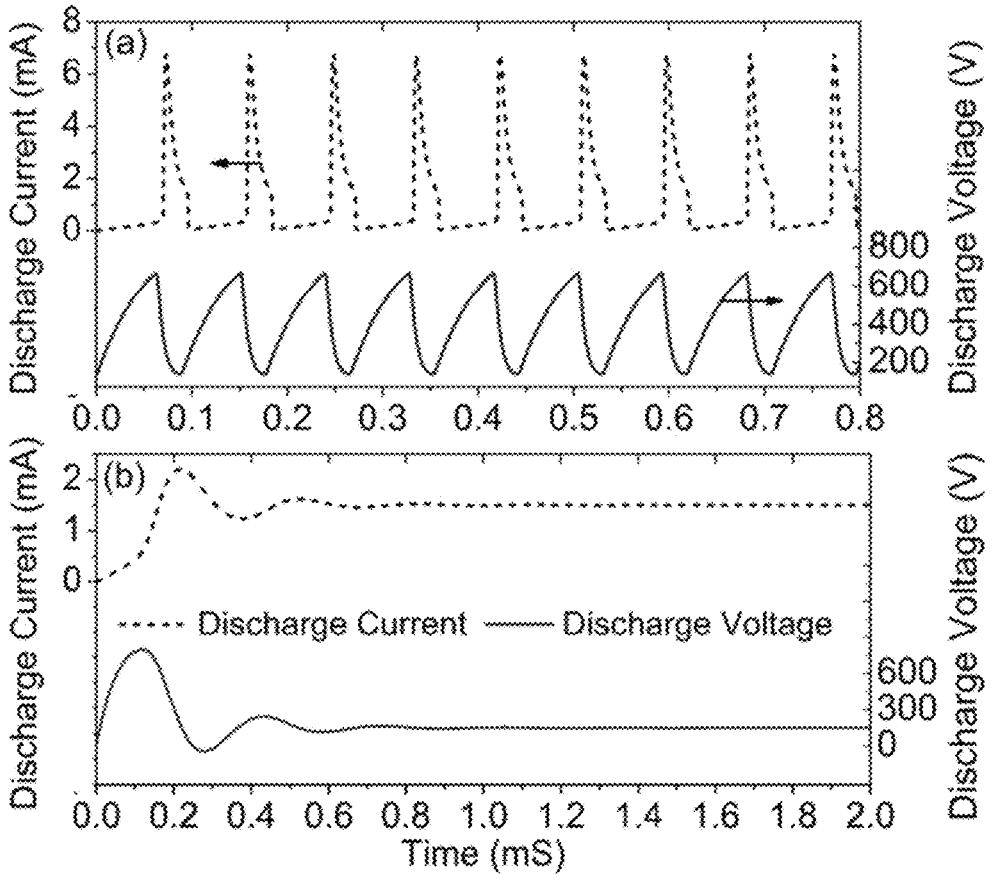
FIG. 6 shows a discharge current profile with the presence of inductor showing: (a) self-pulsation ($L_x$=0.01 H); and (b) damped oscillation ($L_x$=20H) ($R_{ballast}$=100 kΩ, $C_p$=100 pF).

The transient discharge voltage and current profile from the circuit equation is shown in FIG. 6. The numerical results are found to predict the experimental trends. For an inductance value of $L_x$=0.01 H, a pulsing of voltage and current (i.e. an oscillatory discharge) is observed in FIG. 6, graph (a). This lower value of inductance corresponds to a value, where $\tau_{L_x/R_{discharge}}<\tau_{R_{ballast}C_p}$, as a result the discharge shows oscillation without any amplitude attenuation. The discharge voltage has a sawtooth like pattern in close resemblance to those of the experiments. Simulation is also conducted in the presence of an inductor of higher magnitude, such that $\tau_{L_x/R_{discharge}}<\tau_{R_{ballast}C_p}$; the oscillation for both the current and voltage is damped resulting in a steady discharge voltage/current at the end (FIG. 6(*b*)). This high inductance value 20H was chosen within the experiment range of 1H to 40H. The model predictions are in qualitative agreement with the experimental results. The presence of an inductor acts as a damping element in the coupled plasma-external circuit. Based on the interaction of the different circuit element, especially the representative characteristics response time, a stability map denoting regimes of pulsing and stable operation can be proposed.

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art using the teachings disclosed herein.

What is claimed is:

1. An instability suppressor circuit for self-pulsing direct current driven microplasma discharge comprising:

a power supply;

a ballast resistor;

a plasma discharge;

an inductor connected in series with the power supply, the ballast resistor and the plasma discharge;

wherein the suppressor circuit adds a positive impedance making plasma from the plasma discharge less sensitive to a change in voltage with respect to a change in current;

wherein the suppressor circuit functions at atmospheric pressure and above; and wherein the inductor increases the combined response time of the plasma and the inductor, such that t $L/R_{discharge}$>t $R_{ballast}C_p$, wherein $R_{ballast}$ is the ballast's resistance, $R_{discharge}$ is a resistance of the plasma discharge, $C_p$ is a parasitic capacitance of an external circuit, and L is the inductor's inductance.

2. The suppressor circuit of claim 1, wherein the plasma discharge characteristics are obtained from the solution of the below equation:

$$V = L_x\frac{dI}{dt} + R_{discharge}I$$

$$V = V_s - IR_{discharge} - R_{ballast}C_p\frac{dV}{dt}$$

wherein V is a plasma/discharge voltage, I is a plasma/discharge current, $R_{ballast}$ is the ballast's resistance, $R_{discharge}$ is the resistance of the plasma discharge, $C_p$ is the parasitic capacitance of an external circuit, and $V_s$ is a voltage of the power supply.

3. The suppressor circuit of claim 1, wherein the inductor shifts a negative differential resistance region into lower current regimes.

4. The suppressor circuit of claim 1, wherein two electrodes having a separation distance of from 100 μm to 400 μm form the plasma discharge.

5. A system for suppressing a self-pulsing regime of a direct current driven micro plasma discharge comprising:

a power supply;

a ballast resistor;

a plasma discharge;

an inductor connected in series with the ballast resistor and plasma discharge;

wherein the inductor suppresses oscillation of the plasma discharge, thereby establishing a steady plasma discharge;

wherein the system comprises a positive impedance making plasma from the plasma discharge less sensitive to a change in voltage with respect to a change in current;

wherein the system functions at atmospheric pressure and above; and wherein varying an inductance value increases a response time of plasma to a value wherein t $Lx/R_{discharge}$>t $R_{ballast}C_p$ thereby making a driving circuit response time shorter, wherein $R_{ballast}$ the ballast's resistance, $R_{discharge}$ is a resistance of the plasma discharge, $C_p$ is a parasitic capacitance of an external circuit, and Lx is the inductor's inductance.

6. The system of claim 5, wherein the system shifts a negative differential resistance region into lower current regimes.

7. The system of claim 5, wherein the plasma discharge characteristics are obtained from the solution of the below equation:

$$V = L_x \frac{dI}{dt} + R_{discharge} I$$

$$V = V_s - IR_{discharge} - R_{ballast} C_p \frac{dV}{dt}$$

wherein V is a plasma/discharge voltage, I is a plasma/discharge current, $R_{ballast}$ is the ballast's resistance, $R_{discharge}$ is the resistance of the plasma discharge, $C_p$ is the parasitic capacitance of the external circuit, and Vs is a voltage of the power supply.

8. The system of claim 5, wherein the plasma discharge is formed between two electrodes having a separation distance of from 100 μm to 400 μm.

* * * * *